US009175581B2

(12) United States Patent
Meyer

(10) Patent No.: US 9,175,581 B2
(45) Date of Patent: Nov. 3, 2015

(54) EXTERNALLY DRIVEN INTERIOR AXIAL CAM

(71) Applicant: Ken Meyer, Fridley, MN (US)

(72) Inventor: Ken Meyer, Fridley, MN (US)

( * ) Notice: Subject to any disclaimer, the term of this patent is extended or adjusted under 35 U.S.C. 154(b) by 162 days.

(21) Appl. No.: 13/971,703

(22) Filed: Aug. 20, 2013

(65) Prior Publication Data

US 2015/0053159 A1 Feb. 26, 2015

(51) Int. Cl.

| | |
|---|---|
| ***F02B 75/18*** | (2006.01) |
| ***F01L 1/26*** | (2006.01) |
| ***F01L 1/04*** | (2006.01) |

(52) U.S. Cl.

CPC ..... *F01L 1/267* (2013.01); *F01L 1/042* (2013.01); *F01L 2250/04* (2013.01); *F01L 2810/02* (2013.01)

(58) Field of Classification Search

CPC ..... F01L 1/042; F01L 1/26; F01L 1/30; F01B 3/045; F01B 3/04

USPC ..... 123/90.21, 90.1, 56.2, 56.3, 56.4, 56.5, 123/56.6

See application file for complete search history.

(56) References Cited

U.S. PATENT DOCUMENTS

| | | | | |
|---|---|---|---|---|
| 1,690,222 | A | 11/1928 | Foertsch | |
| 1,740,040 | A | 12/1929 | Sapienza | |
| 2,265,171 | A | 12/1941 | Johnson | |
| 6,505,590 | B1 | 1/2003 | Rao | |
| 2006/0213292 | A1 * | 9/2006 | Thomas | 74/56 |
| 2008/0006237 | A1 * | 1/2008 | Page | 123/241 |
| 2008/0060596 | A1 * | 3/2008 | Decuir | 123/90.16 |
| 2008/0105117 | A1 * | 5/2008 | Kubes et al. | 92/153 |
| 2008/0105222 | A1 * | 5/2008 | Kubes et al. | 123/52.1 |
| 2008/0105223 | A1 * | 5/2008 | Kubes et al. | 123/56.1 |
| 2009/0145377 | A1 * | 6/2009 | Gaiser et al. | 123/53.3 |

* cited by examiner

*Primary Examiner* — Thomas Denion
*Assistant Examiner* — Daniel Bernstein

(57) ABSTRACT

An axial cam with a plurality of followers mounted within its diameter drives the followers in both axial directions. The followers operatively actuate valves such as those of an internal combustion engine. The cam can be driven about its exterior perimeter, providing an axially compact embodiment. The phasing of select followers can be established by modifying the azimuth positions of those followers with the cam in operation. By providing the cam with a symmetric actuating profile its followers can be linked to alternately actuate same-function valves in different engine cylinders.

16 Claims, 7 Drawing Sheets

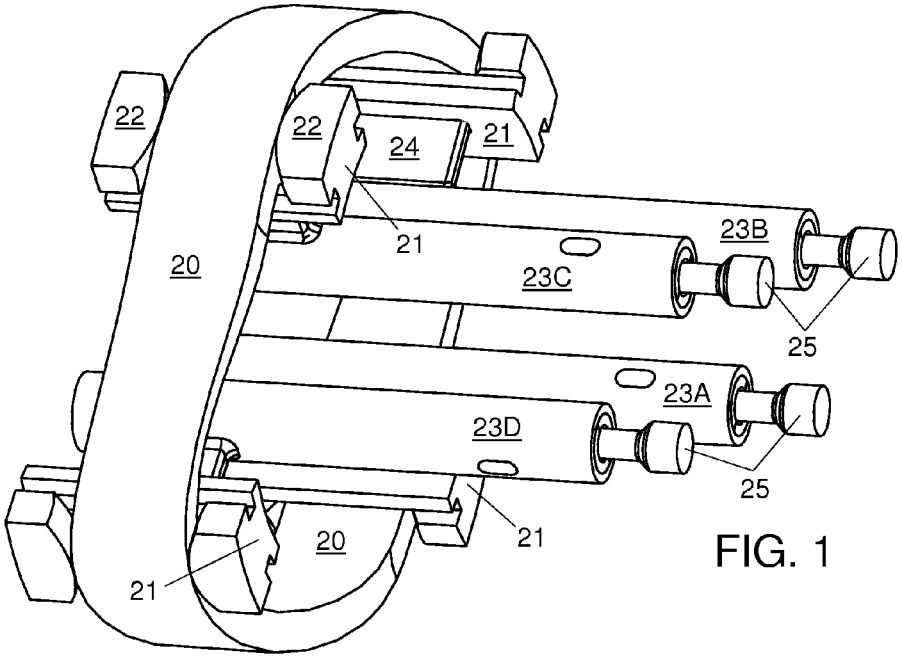
FIG. 1
FIG. 2
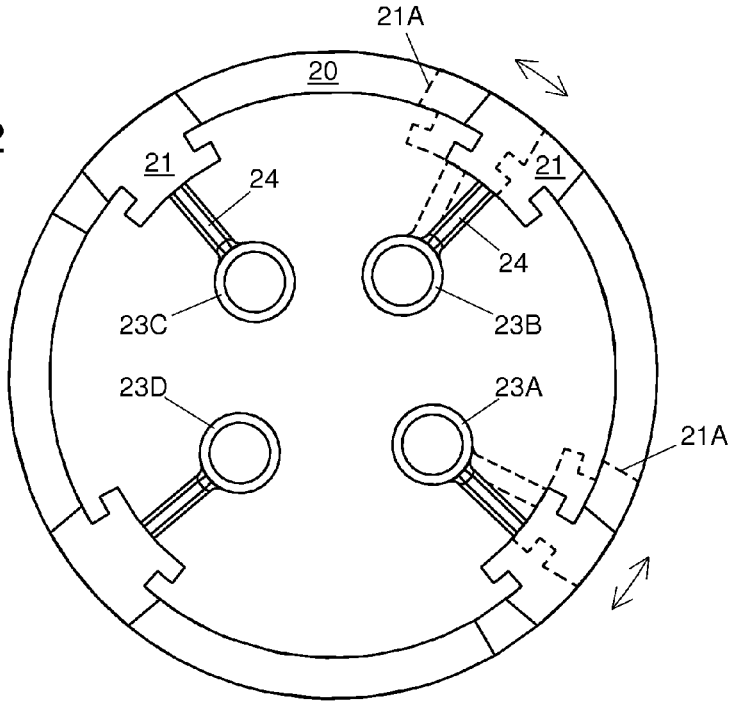

FIG. 3
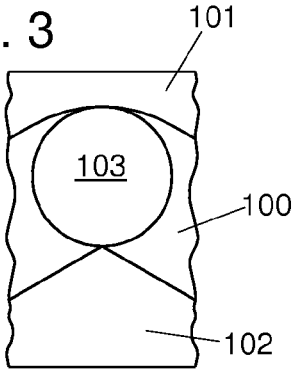
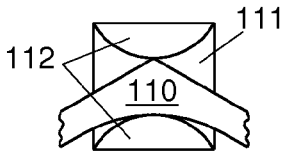
FIG. 4
FIG. 5
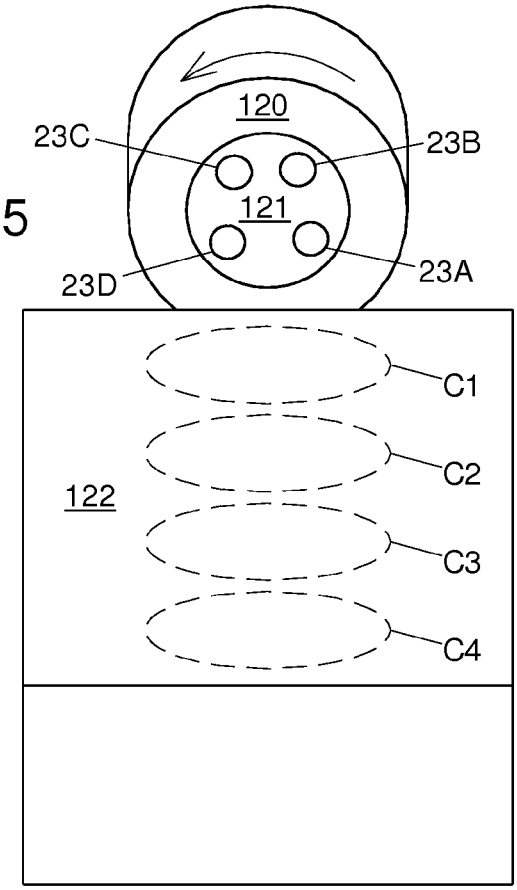

| CYLINDER | C1 | C2 | C3 | C4 |
|---|---|---|---|---|
| EXHAUST DRIVER | 23D(+) | 23C(+) | 23C(-) | 23D(-) |
| INTAKE DRIVER | 23A(+) | 23B(-) | 23B(+) | 23A(-) |
| FIRING ORDER | 1 | 4 | 2 | 3 |

EXTERNALLY DRIVEN INTERIOR AXIAL CAM

TECHNICAL FIELD

The present disclosure pertains to axial cams that drive a plurality of followers, and especially to axial cams that operatively actuate valves that provide for ventilation of positive displacement chambers.

BACKGROUND

Hundreds of millions of internal combustion engines employ exhaust valves, most also employing intake valves, in positive displacement working chambers of those engines to ventilate them. A positive displacement chamber is a substantially sealed variable volume enclosure. Most such chambers are piston-and-cylinder with a cylinder head in which the valves are located. Typically, such a valve is actuated by a cam follower driven by a cam that is driven by the engine crankshaft. The timing of the valve's actuation is according to the cam's rotational position with respect to the follower and the crankshaft.

The cam that is most often used can be called a radial cam, and runs the length of an engine's cylinder head. Thus, it occupies a sizable footprint on the cylinder head. A radial cam is mounted to rotate about an axis and has lobes to shove its followers radially away from the axis, to actuate the engine valves. A radial cam tends to be massive, needing to be both strong and torsionally stiff to fulfill its service life. Such a cam needs several closely aligned bearings along the length of the cylinder head, which itself is rather squirmy under engine heat and load conditions. A radial cam usually has one lobe for each follower that it actuates, and each engine cylinder requires as many as five followers. The form of the cam lobes is convex, of a short radius, and the followers are also typically convex: their contact surfaces thus experience high Hertzian loads in operation. A radial cam is large and heavy, demanding in its bearing alignment, expensive in the forming of its many lobes, and suffers cam and follower contact surface degradation.

Modification of a cam's timing of its follower actuations, called "phasing," is often desired with today's emphasis on engine emissions control and fuel efficiency. Phasing of a radial cam is done by interposing a mechanism that rotates with the cam, between the cam and its driving member. The mechanism is precisely made and closely regulated in operation, adding complexity to its bulk. A radial cam also needs careful attention paid to its surface lubrication, since lubricating oil tends to be flung from its surfaces. Thus, oil galleries are bored through the cam at additional expense.

An axial cam, often called a barrel cam, is short and can drive several followers from a single contact surface. As the axial cam rotates about its axis, the followers are driven axially by a contact surface of the cam. By incorporating another, oppositely facing, contact surface its followers can be driven in each axial direction by the cam. Axial cams are well known to be strong and long-enduring, and when employed to drive an engine's valve system require no bearings down the length of the cylinder head. Driven rods are deployed from the followers to operatively actuate the valves. With an axial cam, merely two contact surfaces need to be formed on it for the driving of its several followers. The cam's contact surfaces are concave where they cause the greatest acceleration to the followers, which are convex: their contact surfaces thus have minimal Hertzian loading. Phasing of an axial cam is done by modifying the mounted position of one or more of its followers about the cam's rotational axis. An axial cam embodiment is short and light weight, needs no special bearing alignment, is inexpensive to manufacture, and is strong and enduring. Minimal complexity and bulk are required for its phasing.

One form of an axial cam embodiment has the cam faces about the outside perimeter of its driving shaft. This is the most common form of axial cam, found in many applications beyond engine valve actuation. However, this form tends to be longer than desired because the driving shaft of the cam needs to itself be driven at one end, which adds length to the cam embodiment. Further adding to this length is the requirement that the cam needs to be stiff against deflection and thus extra axial thickness is given to the cam.

The present disclosure comprises an axial cam with oppositely facing cam surfaces fixed to a rotating exterior shell. The cam comprises a central cavity, within which at least a portion of each of its followers is mounted about the cam's rotational axis. The followers communicate their axial positions through an open end of the central cavity. Such a cam can be called an interior axial cam. The cam can be driven about its external perimeter with such as a belt drive or by gears, and its cam faces are given strength and stiffness by the exterior shell: thus, it is particularly compact axially. Lubricating oil forms a layer that is centrifugally flung against the inside surface of the rotating shell, contact between the oil layer and the followers splashing oil continuously against the cam contact faces.

The present disclosure is anticipated to be effective in operatively actuating those valves that ventilate positive displacement chambers in machines, whether in engines or in other devices such as compressors.

BRIEF DESCRIPTION OF THE DRAWINGS

FIG. 1 is a perspective of an axial cam system.

FIG. 2 is an isolated end view of the axial cam system of FIG. 1.

FIG. 3 is a schematic of a planar cam and its follower.

FIG. 4 is a schematic of a planar cam and its follower.

FIG. 5 is an elevated end-view schematic of the FIG. 1 cam system mounted on a cylinder head.

DETAILED DESCRIPTION OF THE DRAWINGS

Figures 6, 7:
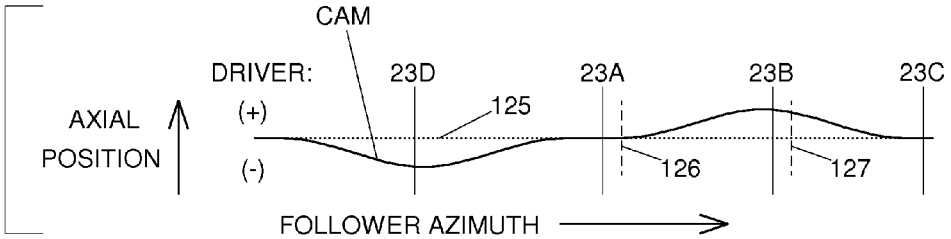
FIG. 6 is a graph of follower azimuth vs axial position for the cam system of FIG. 1.
FIG. 7 is a table of the drivers from the FIG. 5 mounted cam system and their actuated valve stations.

A system comprising an axial cam with a plurality of followers inside its diameter, which followers are driven in both axial directions by rotation of the cam, is shown in FIG. 1. A cam 20 is cylindrical and rotates about its axis, called the "central axis." Its axial faces are formed to drive a follower 21 that translates parallel to the central axis. There are four followers 21 shown fitted on cam 20, each follower 21 translating along guide slots in its sides parallel to the central axis at a predetermined azimuth. "Azimuth" is an angular position about the central axis with respect to a reference plane that includes the central axis. Each follower 21 comprises two contacts 22 that have a spherical face in contact with cam 20. The followers 21 are fit onto cam 20 by canting them slightly at a narrow portion of cam 20. Each follower 21 has a splayed center slot that receives a fin 24 of a driver 23 (FIG. 11), each driver 23 comprising a hollow cylindrical portion and being linked to a pawn 25. Each of drivers 23A, 23B, 23C, and 23D ("23A-D") is a driver 23.

The axial faces of cam 20 can be formed with a conformal cross section to their contacts 22. A method of doing so is to first position a spherical cutter of the radius of the contact 22 spherical face. Then cam 20 is positioned with its cylindrical axis at a distance from the cutter-center equal to the sphere-center distance of the contact 22 from the central axis. The axial displacement of cam 20 with respect to the cutter then is varied according to predetermined parameters as cam 20 is rotated about its cylindrical axis. With this forming done for both axial faces, the shape of cam 20 is established as consistently conformal to its contact 22 faces. Cam 20 is drawn to indicate conformal contact with its followers 21.

Cam 20, the followers 21, and the drivers 23 are shown in FIG. 2 as an end view along the central axis from the right side of FIG. 1. Each fin 24 is fit into its follower 21 that is fitted on cam 20. Each driver 23 translates along the axis of its cylindrical portion, the axes fixed in azimuth parallel to and equidistant from the central axis. The followers 21 of 23A-B display an optional azimuth offset represented in each case by an offset 21A, the azimuth range of each of these followers 21 indicated with an arrow. The followers 21 of 23A-B arc about the central axis throughout their azimuth ranges at a constant 90 degrees apart, the splayed center slot of each follower 21 accommodating its fin 24 at varying relative angles. The followers 21 of 23C-D are fixed in azimuth at ninety degrees apart.

A limiting case of cam-and-follower shape is represented in schematic FIG. 3. A follower 103 is cylindrical and translates longitudinally, positioned by a cam 100 that translates laterally. Cam 100 comprises a contact 101 and a contact 102 that contact follower 103. A surface of contact 101 is cylindrical about a tip of contact 102 at a radius equal to the diameter of follower 103. As cam 100 translates past follower 103, the perimeter of follower 103 traces along contact 101 and the center of follower 103 arcs with respect to the tip of contact 102 at a radius equal to that of follower 103. A kinematic equivalent to FIG. 3 is shown in FIG. 4. A follower 111 comprises two contacts 112 that contact a cam 110, each contact 112 comprising a face that is cylindrical of a radius equal to that of follower 103. Follower 111 translates longitudinally and is positioned by cam 110, which translates laterally. A cylindrical face of cam 110, that is of a radius equal to the diameter of follower 103, is traced by one contact 112 and the opposite face of cam 110 has tip-contact with the other contact 112. Each point on follower 111 traces an arc, with respect to cam 110, of a radius equal to the radius of follower 103.

FIG. 5 is an elevated end-view schematic showing a mounting of the axial cam system of FIG. 1 on an internal combustion engine cylinder head. A shell 120 is rotatably mounted about a core 121, which is fixed to a cylinder head 122 with the rotational axis of shell 120 generally parallel to the top of cylinder head 122. Shell 120 is fixed against axial movement and is rotated by means known in the art, such as with a timing belt or by gears, in a predetermined relationship with the engine crankshaft. Cylinder head 122 shows projections of four cylinders: a C1, a C2, a C3, and a C4. C1-C4 indicate cylinders beneath cylinder head 122, each of which comprises an exhaust valve "station" (i.e., one or more valves of like function in one cylinder) and an intake valve station, the valve stations operatively driven by shell 120. Cam 20 (not shown) is fixed inside shell 120 with the central axis collinear to the rotational axis of shell 120. Slidably mounted on and extending from core 121 are 23A-D, which are driven by cam 20 as in FIG. 1. An arrow indicates the rotational direction of shell 120, which rotation is continuous with the engine's operation.

In FIG. 6 an entry "CAM" graphs a curve showing the axial position that cam 20 effects on the center of any follower 21 it drives according to the cam system of FIG. 1. The azimuth of any follower 21 with respect to the azimuth of cam 20 is its "FOLLOWER AZIMUTH," shown on the CAM graph through 360 degrees. Lines that intersect the CAM curve below the "DRIVER" entries indicate the follower azimuths of the followers 21 that axially position, respectively, 23A-D. A 125 along the CAM graph indicates an axial middle position. The followers 21 driving, respectively, drivers 23A and 23C are at middle position. The position of any driver 23 is identified as the position of its driving follower 21, so drivers 23A and 23C are at middle position. A "(+)" sign indicates an axial position that is on the opposite side of middle position from an axial position indicated with a "(−)" sign. Driver 23D is in the (−) "range" and driver 23B is in the (+) range. A 126 indicates the offset 21A position of driver 23A, and a 127 indicates the offset 21A position of driver 23B, as described with FIG. 2. Applying the CAM graph to FIG. 5, the "(+)" sign indicates a driven position closer to cylinder head 122 and the "(−)" sign indicates a driven position farther from cylinder head 122. The CAM curve axial displacement from middle position at any follower azimuth is the negative value of the axial displacement 180 degrees from it, a property called "functional symmetry".

FIG. 7 is a table that identifies by which driver 23 and in which range of that driver 23 a given valve station of the mounted cam system of FIG. 5 is actuated, anticipating that each driver 23 is linked to operatively actuate two valve stations alternately. A "CYLINDER" entry indicates a cylinder. An "EXHAUST DRIVER" entry indicates the driver 23 that actuates the cylinder's exhaust valve station, and the range of the indicated driver 23 in which the actuation is effected. An "INTAKE DRIVER" entry indicates the driver 23 that actuates the cylinder's intake valve station, and the range of the indicated driver 23 in which the actuation is effected. As an example, a (+) range of driver 23A actuates the C1 intake valve station but does not actuate the C4 intake valve station: a driver 23A(−) range does actuate the C4 intake valve station but not the C1 intake valve station. A "FIRING ORDER" entry indicates the timing of the cylinder's ignition event relative to the ignition events of the other cylinders.

Figure 8:
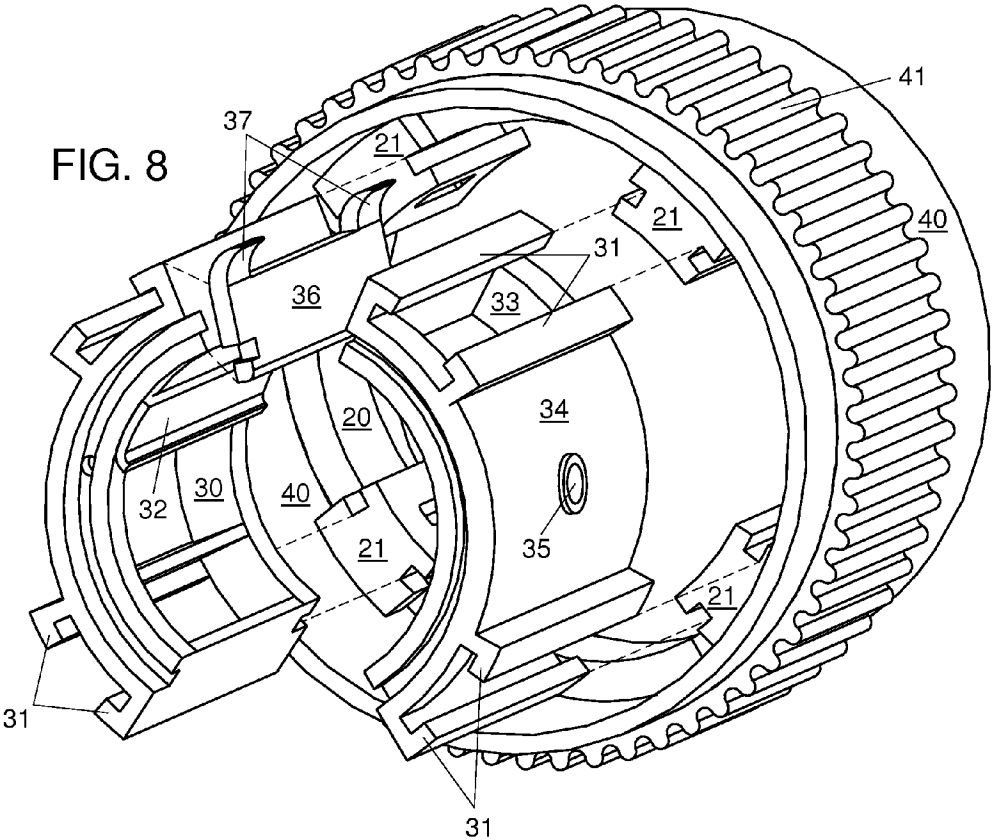
FIG. 8 is an assembly stage perspective of an embodiment of the FIG. 1 cam system.

Perspective FIG. 8 shows an assembly stage of an embodiment that comprises the axial cam system of FIG. 1. Cam 20 is fixed inside a shell 40 that has fixed to it a comb 41, the axial cam body so formed comprising a central cavity that borders both axial faces of cam 20 and opens out of each end of shell 40. Shell 40 is cylindrical and comb 41 has cog teeth about its perimeter. Four followers 21 are fit onto cam 20, followed by two of the followers 21 being fit onto a carrier 30 and the other two followers 21 being fit onto a carrier 33. Carrier 30 comprises two semi-annular faces, each with an annular groove and an axial bore in the groove. Four guides 31 fixedly connect the carrier 30 faces, each guide 31 comprising a flange to fit into a guide slot in its follower 21. A pan 32 is fixed to an inner radius of carrier 30. Carrier 33 comprises two semi-annular faces, each with an annular groove. Four guides 31 fixedly connect the carrier 33 faces, the guide 31 flanges fitting their respective followers 21. A stiffener 34 is fixed to an outer radius of carrier 33 and an eyelet 35 is fixed into stiffener 34, eyelet 35 comprising a bore normal to the central axis. A scupper 36 that comprises two scoopers 37 and has a short annular groove on each end is fit against an end of carrier 30 once carrier 30 is slid onto its followers 21.

Figure 9:
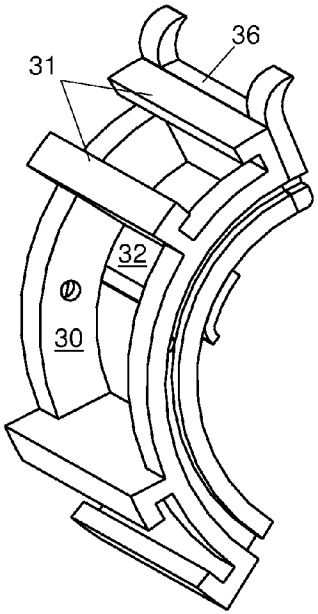
FIG. 9 is a perspective of one follower carrier from FIG. 8.

Perspective FIG. 9 isolates carrier 30 to show its guides 31, its pan 32, its axial bores, and the fit that scupper 36 is given against carrier 30 once assembled.

Figure 10:
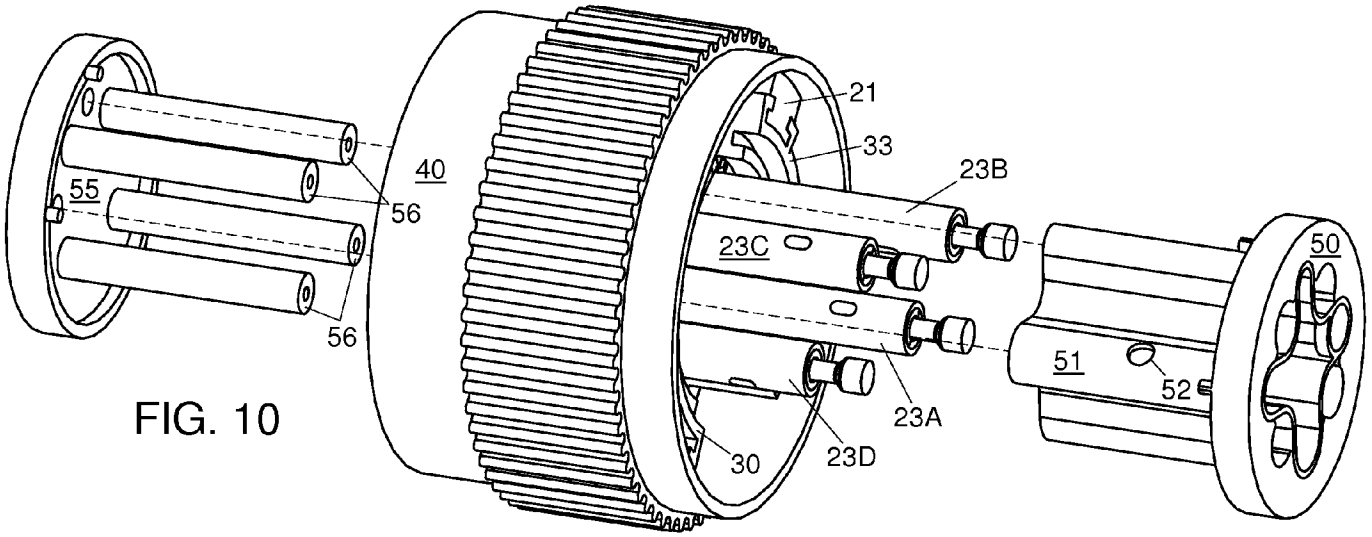
FIG. 10 is a further assembly stage perspective of the embodiment of FIG. 8.

Perspective FIG. 10 shows further assembly of the embodiment of FIG. 8. 23A-D are each fit into their respective followers 21, such that the fin 24 of each driver 23 slides into the splayed center slot of its follower 21. A tail 55 has an annular rim that fits into one annular groove on each of carrier 30, scupper 36, and carrier 33. Fixed to tail 55 are four mandrels 56, each of which is cylindrical with a center bore and parallel to the central axis. The mandrels 56 are slid into the hollow centers of the drivers 23, which they closely fit. Tail 55 has two dowels protruding axially from its annular rim, one dowel being fit into one axial bore of carrier 30 and the other dowel being fit against the broad face of scupper 36 that does not contact carrier 30. A nose 50 has an annular rim that fits into the other annular groove on each of carrier 30, scupper 36, and carrier 33. Nose 50 has two dowels protruding axially from its annular rim, one dowel to be fit into the other axial bore of carrier 30 and the other dowel to be fit against the broad face of scupper 36 that does not contact carrier 30. The axial face of nose 50 has axial bores that closely fit an outer-circumference portion of each of the four drivers 23. A volute 51 is an extrusion-like shape that is configured to nestle among the four drivers 23, conforming to the radially inner edges of the drivers 23. Nose 50 is shaped to fit volute 51, to which it is fixed. A seep 52 is bored through volute 51.

Volute 51 is roughly "plus"-shaped, in cross-section. At the tail 55 end of volute 51, a bored block is fixed into each arm of the "plus" shape. The two vertically opposite bored blocks are aligned with bores through tail 55. The two horizontally opposite bored blocks are internally threaded, and aligned with bores through tail 55. Bolts are fastened through tail 55 into the threaded bored blocks. With volute 51 fastened to tail 55, the drivers 23 protrude from nose 50 and carrier 33 is free to wander some in azimuth.

Figure 11:
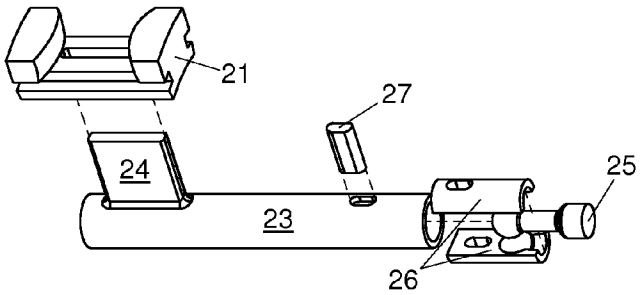
FIG. 11 is an isolation of a follower from FIG. 1 with its output linkage.

FIG. 11 isolates one follower 21 with its linked output members, each follower 21 being so linked at full assembly. Pawn 25 has a spherical end, a stem, and a cylindrical end. The cylindrical end is ready to be connected to a driven rod. Fitting closely about the spherical end of pawn 25 are two keepers 26, their end bores splayed to allow the stem of pawn 25 some nutation. A slot in each keeper 26 fits a key 27, which when the keepers 26 enclose pawn 25 and are slid into driver 23, is press fit into a slot through driver 23 to lock the keeper 26 into place.

Figure 12:
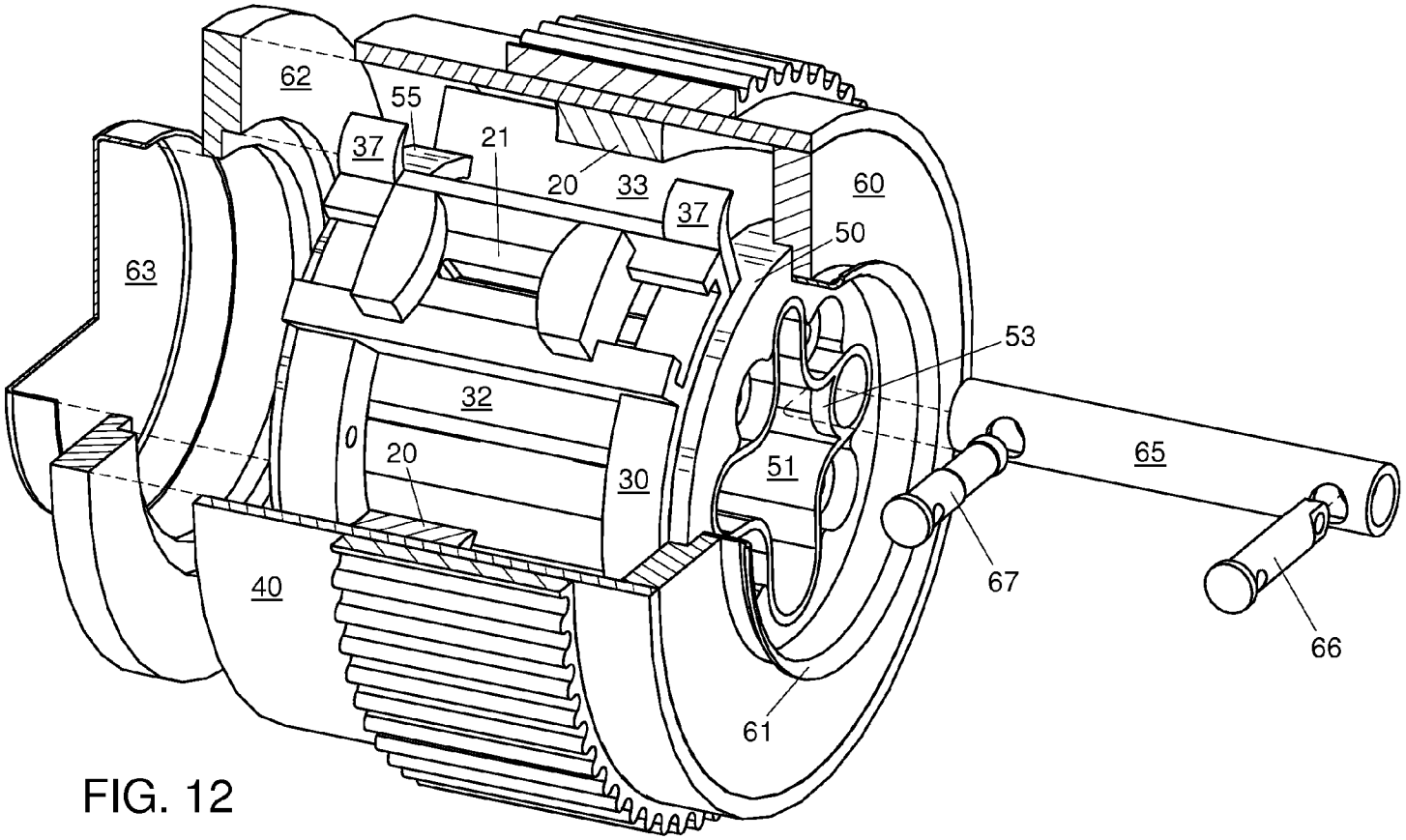
FIG. 12 is a further assembly stage perspective of the embodiment of FIG. 10.

Sectional perspective FIG. 12 shows further assembly of the embodiment of FIG. 10. The 23-27 are isolated from FIG. 12 for purposes of display. A front 60 and a back 62 are each generally annular and comprise an inner-radius shoulder to rotatably mount on, respectively, nose 50 and tail 55. The outer perimeter of each of, front 60 and back 62, is fastened to the inner face of shell 40. A slinger 61 is slid inside an annular oil seal (not shown) and then fit inside front 60. An end 63 will be fit inside back 62 during later assembly. A phaser 65 is slid through a ferrule 53 that is part of volute 51, and a coupler 67 is then fit part way through a bore in phaser 65. Coupler 67 is spherical at one end. Phaser 65 then is slid further into volute 51 until the spherical end of coupler 67 is fit into eyelet 35 (FIG. 8), which it closely fits. A coupler 66 then is fit through another bore in phaser 65 and a long pin (not shown) is fit through a small bore in each of couplers 66 and 67 to lock them into place.

Figure 13:
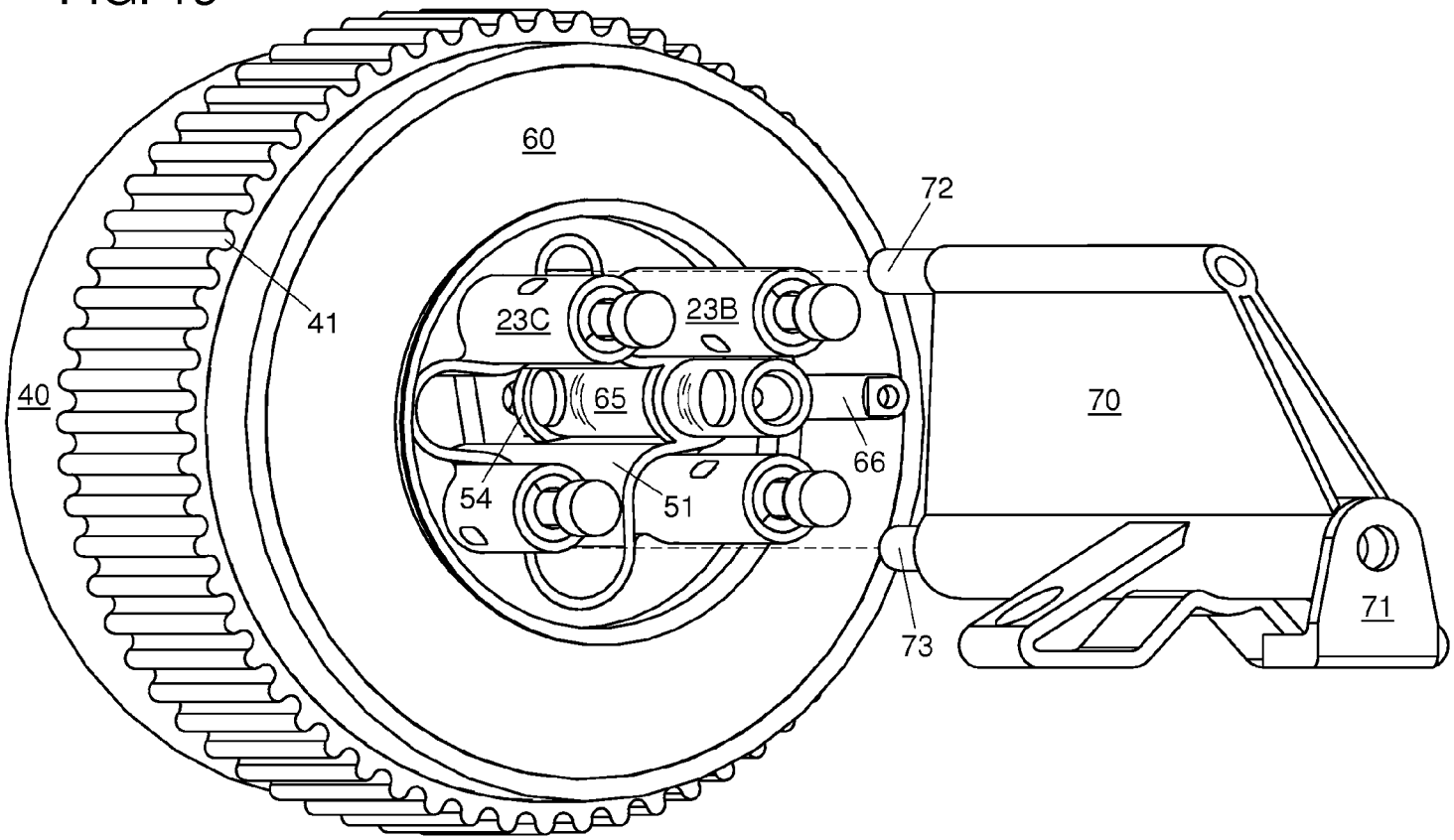
FIG. 13 is a concluding assembly perspective of the embodiment of FIG. 12.

Perspective FIG. 13 shows the embodiment of FIG. 12 at the point of full assembly. A beam 70 comprises a lateral bracket with bores for bolting to a cylinder head deck, and has a threaded bore that aligns with a bore in a bracket 71. Cylindrical sections of beam 70 closely fit their respective vertically opposite arms of volute 51. A rod 72 and a rod 73 have threaded ends and are members of beam 70 that are fit through bored blocks in volute 51 and bores in tail 55. The ends of rods 72 and 73 are secured through tail 55 with nuts, and end 63 is then fit into back 62. With end 63 fit into back 62 the central cavity inside shell 40 has a single open end, through which the drivers 23 communicate their axial positions. Bracket 71 has a bore through its horizontal face for its mounting to the deck. Phaser 65 is seen rotatably mounted within each of, ferrule 53 and a ferrule 54 that is part of volute 51.

Operation

An axial cam can drive a plurality of followers. The followers of an axial cam can be located within its diameter, producing a compact embodiment. An axial cam can drive its followers in both axial directions by having axial contact-faces that face in, respectively, both axial directions. An axial cam that drives a plurality of followers within its own diameter in both axial directions is disclosed in FIGS. 1-2. As cam 20 rotates with respect to the followers 21, the followers 21 are driven axially and they position their drivers 23. The pawns 25, linked to the drivers 23, are ready to deliver the cam's output.

A follower's "phase" refers to the timing of its actuation by the cam with respect to the cam's azimuth position. Setting the phase of an axial cam's follower is a matter of setting the azimuth position of that follower. By repositioning the azimuth of a follower, especially with the cam in operation, the phase of that follower is shifted. In FIG. 2 23A-B can be phase-shifted by varying the mounted azimuth positions of their respective followers 21, which are kept 90 azimuth degrees from each other at all times. The followers 21 of 23C-D are fixed in their azimuth positions, which are also 90 degrees apart. The azimuth positions of the followers 21 anticipate that 23A-B will drive the intake valves, and that 23C-D will drive the exhaust valves, of a four-stroke four cylinder internal combustion engine.

A limiting case of a planar cam and follower system that approximates an axial cam system is shown in FIGS. 3-4. As cam 100 translates laterally the center of follower 103 describes an arc, with respect to the tip of contact 102, whose radius is the same as that of follower 103. This arc represents a maximum case of acceleration that can be applied to follower 103 by cam 100. Any stronger-acceleration profile would result in a gap at the tip shown of contact 102, and would tend to be unstable in usage. The same case of acceleration is provided by its kinematic equivalent system of FIG. 4. The acceleration represented by the limiting case of FIG. 4 is more than threefold than that of the actuation profile of cam 20, which is sinusoidal, shown in FIG. 6. Hence, a significant acceleration can be delivered through cam 20 to its followers.

An axial cam can have contact faces that bracket its follower as in FIG. 3, or it can be bracketed by contact faces of its follower as in FIG. 4 and in cam 20. Follower 103 can be either rotating or non-rotating. The contacts 112 are shown as non-rotating cylinder segments, but instead they can be replaced by rotating followers. Just as follower 103 and the contacts 112 can be either rotating or non-rotating, so can the followers of an axial cam be either rotating or non-rotating. The contacts 22, for instance, are non-rotating.

In FIG. 5 a single axial cam drives the entire valve system for a cylinder head's engine. With the axial displacement profile of cam 20 having functional symmetry as indicated with FIG. 6, each of 23A-D can actuate two valve stations alternately. For such an alternating actuation, each driver 23 is linked to operatively actuate its respective pair of the following valve stations: a first valve station that responds to being driven on one side of middle position but need not respond on the other side of middle position; and a second valve station that is configured such that its own response is opposite, with respect to middle position, to that of the first valve station. Particular to the layout of FIG. 5 is that each driver 23 alternately actuates valve stations of like function (e.g. exhaust-exhaust) in separate cylinders. An example of such a driven system of alternating actuation is disclosed in my U.S. Pat. No. 8,955,482. By being linked to respective members of such a driven system of alternating actuation, as detailed with FIG. 7, 23A-D effect both of intake and exhaust valve actuations for all four cylinders of a four-cylinder internal combustion engine. The layout of FIG. 5 also can be applied to each cylinder head of a V8-type engine.

Instead of employing a single axial cam to actuate a cylinder head's intake and exhaust valves, two separately mounted axial cams driven in common can be employed. One axial cam in such a layout would operatively drive the intake valves and the other axial cam would operatively drive the exhaust valves. Such axial cams would typically not have functional symmetry in their cam displacement profiles, and any phasing of such a cam's follower would typically be applied to all of that cam's followers collectively.

FIG. 7 presumes a well-known engine layout, in which the end-cylinder pistons of a four-cylinder engine are timed to rise and fall simultaneously, and in which the middle-cylinder pistons are timed 180 crankshaft degrees apart from them.

In FIG. 8, cam 20 is fixed inside shell 40 but shell 40 can instead be fixed to cam 20 at a later stage of assembly, such as that of FIG. 12. Comb 41 is located at a suitable axial location on shell 40 to receive a driving belt from a sprocket on its engine's crankshaft. As drawn, the exterior perimeter of comb 41 surrounds the central cavity in at least one plane that is normal to the central axis. The followers 21 are ready to slide along their guides 31 and eyelet 35 is ready to receive the end of coupler 67, in later assembly, that fixes it in azimuth. Scupper 36 is provided to scoop oil from the inner perimeter of shell 40 as it rotates, so that a definite layer of lubricating oil will be incident but not so thickly that operating efficiency is compromised. The oil that the scoopers 37 scoop from the inner surface of shell 40 splashes down against volute 51 and then, guided by pan 32, through seep 52 to leak out to the cylinder head deck. Stiffener 34 provides torsional stiffness to carrier 33, whereas carrier 30 has its torsional stiffness provided to it through its axial bores and their dowels.

In FIG. 10 the drivers 23 are axially slidable along their mandrels 56, and guided through nose 50 by the drivers' close fit between nose 50 and volute 51. The annular rims of nose 50 and tail 55 mount carrier 30, scupper 36, and carrier 33, allowing carrier 33 rotation. The dowels on nose 50 and tail 55 fix carrier 30 in azimuth, and place scupper 36 against carrier 30. Volute 51 provides stiffness between nose 50 and tail 55, while bolts secure volute 51 to tail 55.

The splayed center slot of follower 21 in FIG. 11 receives its fin 24, and the keepers 26 mount their pawn 25. The mounted location of the keepers 26 is such that they do not contact their mandrel 56 in operation.

Front 60 and back 62 in FIG. 12 bear both of axial and radial loads from the cam in operation. Each of front 60 and back 62 has a shoulder that contacts its respective nose 50 or tail 55 to bear these loads. These mountings are plain bearings as shown, though antifriction bearings also would be practical. Slinger 61 slings oil from its flared end and mounts an annular oil seal that is fit into the cylinder head's cover (not shown). End 63 encloses one end of the axial cam body and retains oil. Phaser 65 rotates within ferrules 53 and 54, and the spherical end of coupler 67 is linked into carrier 33.

Beam 70 provides a cantilever mount for the axial cam in FIG. 13. Bracket 71, and brackets on beam 70, are bolted to the cylinder head deck. With the bolting of bracket 71 to beam 70, the axial cam is mounted to its cylinder head. Coupler 66 is linked at one end to means known in the art, such as a servomotor (not shown), that positions carrier 33 at a suitable operating azimuth. The azimuth of carrier 30, being fixed, is independent of the azimuth setting of carrier 33.

The assembled embodiment of FIG. 13 anticipates that it will be employed to drive valve stations of an internal combustion engine in the same manner as that of the mounted cam system described with FIG. 5. Such an employment provides a cam that occupies little space on its cylinder head, requires the forming of but two follower-contact faces, is lightweight and readily assembled, needs no longitudinal bearings down the cylinder head deck, and can readily have its output phase-shifted.

The embodiments of this specification are for the purposes of disclosure and are not to be taken as limiting the present disclosure as defined in the claims.

I claim:

1. A system that operatively actuates a plurality of valves that provide for ventilation to at least one cylinder of an internal combustion engine, in which system:

an axial cam that comprises a first contact face and a second contact face and a central cavity is both of, mounted and driven, to rotate about an axis;

the central cavity borders the first contact face and proceeds between it and the axis to an open end, the first contact face facing axially away from the open end;

a plurality of followers are mounted at respective azimuths about the axis, each follower driven in one axial direction by the first contact face and in the other axial direction by the second contact face;

the followers are driven by the axial cam at timings distinct from one another;

each follower communicates its driven position by an operative linkage that proceeds immediately from that follower's contact with the first contact face, through the central cavity, and out through the open end;

and each follower by so communicating its driven position operatively actuates at least one valve.

2. The system of claim 1 in which one axial cam operatively actuates both of, an exhaust valve and an intake valve, for at least one cylinder of the internal combustion engine.

3. The system of claim 1 in which at least one follower is mounted such that its azimuth position can be modified with the cam in operation.

4. The system of claim 3 in which at least one other follower is mounted such that its azimuth position is independent of the modification applied to the one follower.

5. The system of claim 1 in which the axial cam is formed to drive its followers with an actuation that substantially manifests functional symmetry.

6. The system of claim 5 in which each follower actuates two like-function valve stations alternately.

7. The system of claim 1 in which the axial cam is driven by means that impart a driving force to the axial cam by engaging features disposed about a radially extreme perimeter of the axial cam, said features intersecting a plane that intersects at least one follower and is normal to the axis.

8. A method of operatively actuating a plurality of valves that provide for ventilation to at least one cylinder of an internal combustion engine, which method comprises the steps of:

providing an axial cam that has a first contact face, a second contact face, and a central cavity;

mounting and driving the axial cam to rotate about an axis;

providing that the central cavity borders the first contact face and proceeds between it and the axis to an open end, the first contact face facing axially away from the open end;

providing a plurality of followers mounted at respective azimuths about the axis;

driving each follower in one axial direction by the first contact face and in the other axial direction by the second contact face, the followers being driven at timings distinct from one another;

and communicating from each follower its driven position by operatively linking that follower from its contact with the first contact face, proceeding immediately through the central cavity and out through the open end such that each follower by so communicating its driven position operatively actuates at least one valve.

9. The method of claim 8 further including the step of operatively actuating with one axial cam both of, an exhaust valve and an intake valve, for at least one cylinder of the internal combustion engine.

10. The method of claim 8 further including the step of mounting at least one follower such that its azimuth position can be modified with the cam in operation.

11. The method of claim 10 further including the step of mounting at least one other follower such that its azimuth position is independent of the modification applied to the one follower.

12. The method of claim 8 further including the step of forming the axial cam to drive its followers with an actuation that substantially manifests functional symmetry.

13. The method of claim 12 further including the step of actuating two like-function valve stations alternately with each follower.

14. The method of claim 8 further including the step of driving the axial cam by means that impart a driving force to the axial cam by engaging features disposed about a radially extreme perimeter of the axial cam, said features intersecting a plane that intersects at least one follower and is normal to the axis.

15. A system that operatively actuates a plurality of valves that provide for ventilation to at least one cylinder of an internal combustion engine, in which system:

an axial cam that comprises a first contact face and a second contact face and a central cavity is both of, mounted and driven, to rotate about an axis;

the central cavity borders the first contact face and proceeds between it and the axis to an open end, the first contact face facing axially away from the open end;

a plurality of followers are mounted at respective azimuths about the axis, each follower driven in one axial direction by the first contact face and in the other axial direction by the second contact face;

at least one follower is mounted such that its azimuth position can be modified with the cam in operation the followers are driven by the axial cam at timings distinct from one another and communicate their respective driven positions through the open end of the central cavity;

and each follower by so communicating its driven position operatively actuates at least one valve.

16. The system of claim 15 in which at least one other follower is mounted such that its azimuth position is independent of the modification applied to the one follower.

* * * * *